US007534132B2

(12) United States Patent
Kuo et al.

(10) Patent No.: US 7,534,132 B2
(45) Date of Patent: May 19, 2009

(54) DUSTPROOF COVER FOR ELECTRICAL CONNECTOR

(75) Inventors: Peter Kuo, Tu-Cheng (TW); Xiao Fan, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/148,979

(22) Filed: Apr. 24, 2008

(65) Prior Publication Data

US 2008/0268725 A1 Oct. 30, 2008

(51) Int. Cl.
*H01R 13/52* (2006.01)

(52) U.S. Cl. ..... 439/521; 220/796; 220/799

(58) Field of Classification Search ..... 439/521; 220/796, 799

See application file for complete search history.

(56) References Cited

U.S. PATENT DOCUMENTS 3,129,839 A * 4/1964 Grimsley ..... 220/799
3,203,577 A * 8/1965 Parker ..... 220/799
3,348,725 A * 10/1967 Fuller et al. ..... 220/799
3,450,299 A * 6/1969 Barbera ..... 220/799
4,170,316 A * 10/1979 LaBarbera ..... 220/799
4,335,756 A * 6/1982 Sharp et al. ..... 220/799
5,183,407 A * 2/1993 Srol ..... 439/135
6,600,109 B1 7/2003 Andre et al.
6,854,616 B2 * 2/2005 Steffan ..... 220/799
7,074,077 B2 * 7/2006 Sakaguchi et al. ..... 439/521

* cited by examiner

*Primary Examiner*—Tho D Ta
(74) *Attorney, Agent, or Firm*—Wei Te Chung

(57) ABSTRACT

A dustproof cover (1, 3) for covering an electrical connector (2, 4) includes an upper wall (10, 30), a bottom wall (12, 32), a back wall (13, 33) associated with lateral walls (11, 31), all of which define a connector receiving room (14, 34) with an opening. A plurality of ribs (15, 16 and 35) are arranged on inner surfaces of one or more of walls and protrude into the connector receiving room. The electrical connector is inserted into the connector receiving room through the opening.

5 Claims, 7 Drawing Sheets

DUSTPROOF COVER FOR ELECTRICAL CONNECTOR

BACKGROUND OF THE INVENTION

1. Field of the Invention

The present invention relates generally to a dustproof cover, and particularly to a dustproof cover protecting an electrical connector effectively.

2. Description of Related Arts

Docking plug connectors are suitable for the transmission of a signal in case a VTR, TV, CD player, tuner, amplifier, etc. Such a docking plug connector is conventionally equipped with a dustproof structure for preventing dust particles or the like from entering the housing thereof when it is not in use. The prior art has discloses a device comprising a protective cap. The protective cap is a hollow chamber that has a single opening, which fits to cover a connector for preventing the connector from contacting with external members that may damage the connector, and furthermore, preventing the connector from being dirtied by dust particles. However, this dustproof cover becomes looser after a number of push-and-pull of the docking plug connector, for the dustproof cover just enwraps the connector, or another saying: there is small resistance located between the dustproof cover and the connector that the dustproof cover may fall off after a number of push-and-pull of the docking plug connector and it can't protect the docking plug connector effectively.

Hence, an improved dustproof cover is desired.

SUMMARY OF THE INVENTION

Accordingly, an object of the present invention is to provide a dustproof cover for an electrical connector, which protects the electrical connector effectively.

To achieve the above object, a dustproof cover for covering an electrical connector includes an upper wall, a bottom wall, a back wall associated with lateral walls, all of which define a connector receiving room with an opening. A plurality of ribs are arranged on inner surfaces of one or more of walls and protrude into the connector receiving room. The electrical connector is inserted into the connector receiving room through the opening.

Other objects, advantages and novel features of the invention will become more apparent from the following detailed description when taken in conjunction with the accompanying drawings.

DETAILED DESCRIPTION OF THE PREFERRED EMBODIMENT

Figure 1:
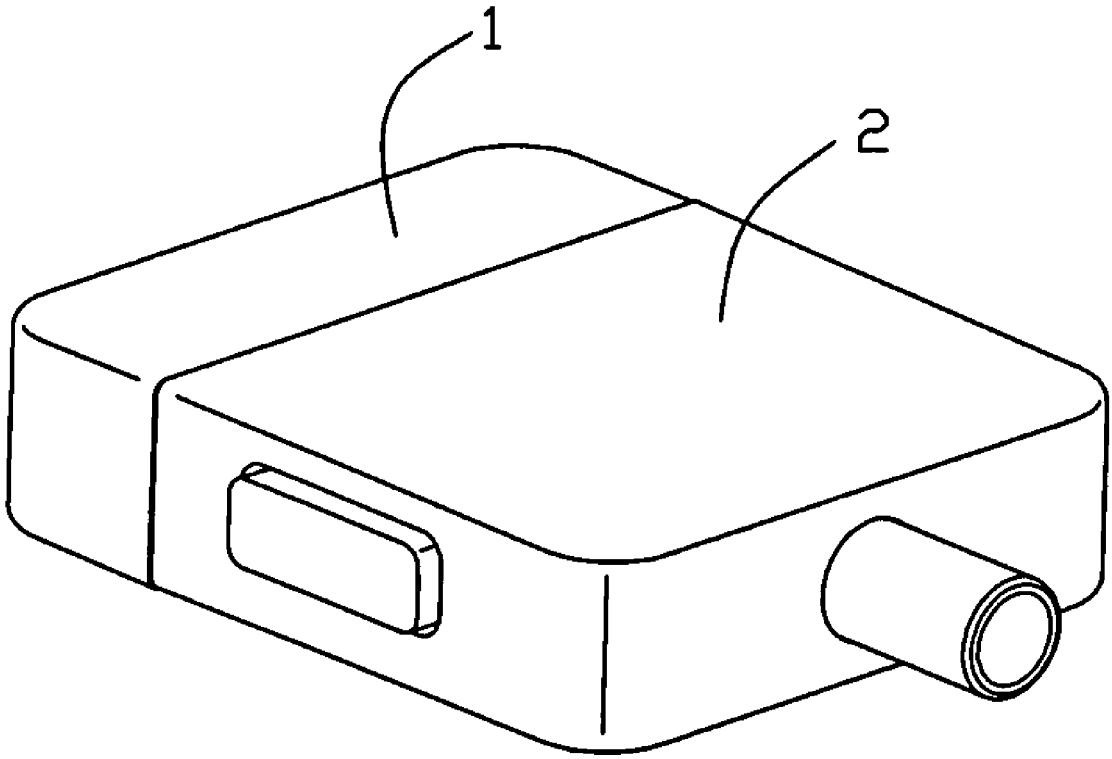
FIG. 1 is a perspective, assembled view of a dustproof cover and an electrical connector in a first embodiment in accordance with the present invention.

FIGS. 1-2 and 5-6 illustrate a dustproof cover 1 and an electrical connector 2 mating with the dustproof cover 1 according to one embodiment of the present invention. The dustproof cover 1 comprises an upper wall 10, a bottom wall 12, a back wall 13 and a pair of lateral walls 11 being vertical to and respectively connecting with the upper, bottom and back walls 10, 12, 13. All of the upper wall 10, the lateral walls 11, the bottom wall 12 and the back wall 13 are smooth surfaces and especially, junction corners of the lateral walls 11 and the back wall 13 are smooth corners. The upper wall 10, the lateral walls 11, the bottom wall 12 associate with the back wall 13 for defining a connector receiving room 14 and defining a connector push-and-pull direction (an end the connector inserted is defined as a back end and the other end the connector pulled out is defined as a front end). The connector receiving room 14 defines a rectangular opening for the electrical connector 2 inserted therethrough. Two first ribs 15 are arranged on the inner surface of the upper wall 10 as well as the inner surface of the bottom wall 12; two second ribs 16 are also arranged on each inner surface of the lateral walls 11. Each first rib 15 comprises a tapered portion 150 having an inclined surface (not labeled) at the front end thereof and a flat portion 151 extending from the tapered portion 150, along a front-to-back direction, to the back wall 13. Each second rib 16 comprises an inclined portion 160 at a front part thereof and an engaged portion 161, shaped in a flat piece, at a back side of the inclined portion 160.

Figure 2:
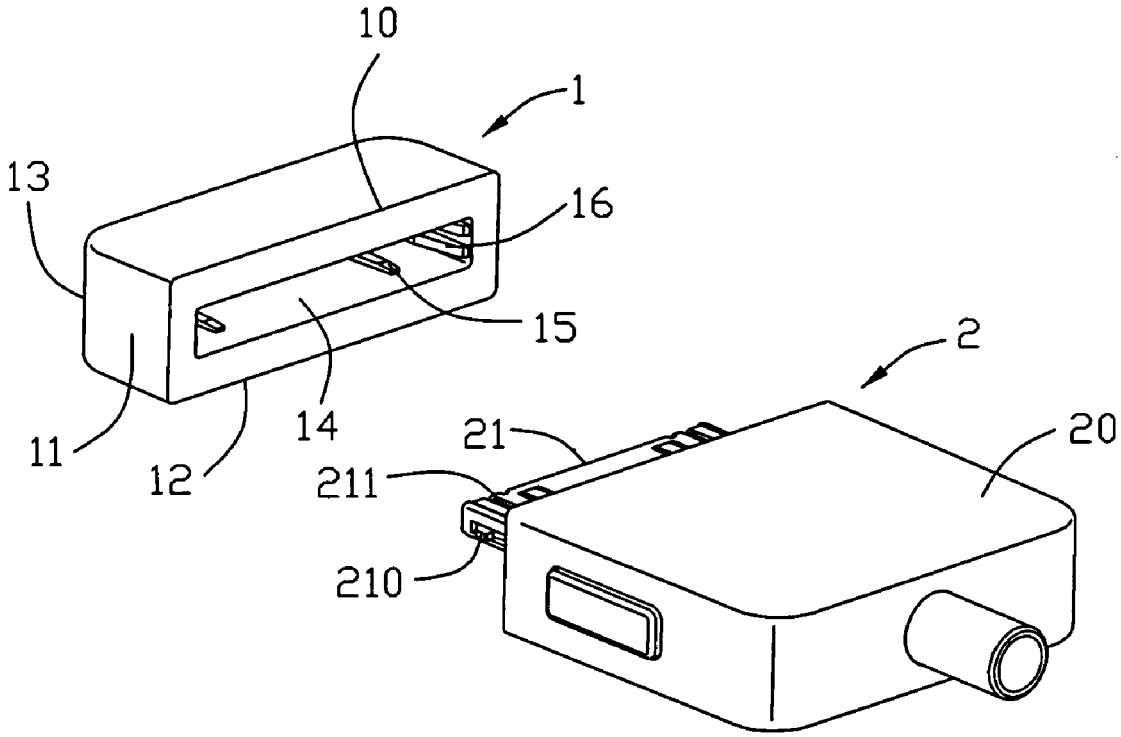
FIG. 2 is a perspective view of the dustproof cover removed from the electrical connector of FIG. 1.

Referring to FIG. 2, the electrical connector 2 comprises an insulating housing 20 and a plug end 21 which is partly received in the insulating housing 20 and partly extends out of the insulating housing 20. The plug end 21 forms a pair of hooks 210 on both sides thereof and guiding slots 211 recessed inward on the upper and lower surfaces thereof. When the plug end 21 of the electrical connector 2 is inserted into the dustproof cover 1, the first ribs 15 are moveably received in the guiding slots 211; the plug end 21 of the electrical connector 2 goes deeper into the dustproof cover 1, the combination between the first ribs 15 and the guiding slots 211 becomes more and more closely; and finally, the hooks 210 arrive at the engaged portions 162 along a trace formed by the second ribs 16 and engage with the engaged portions 162 for preventing the dustproof cover 1 from falling off from the electrical connector 2. The dustproof cover 1 effectively prevents the plug end 21 of the electrical connector 2 from contacting with external members that may damage the plug end 21, and furthermore, prevents the plug end 21 from being dirtied by dust particles.

Figure 3:
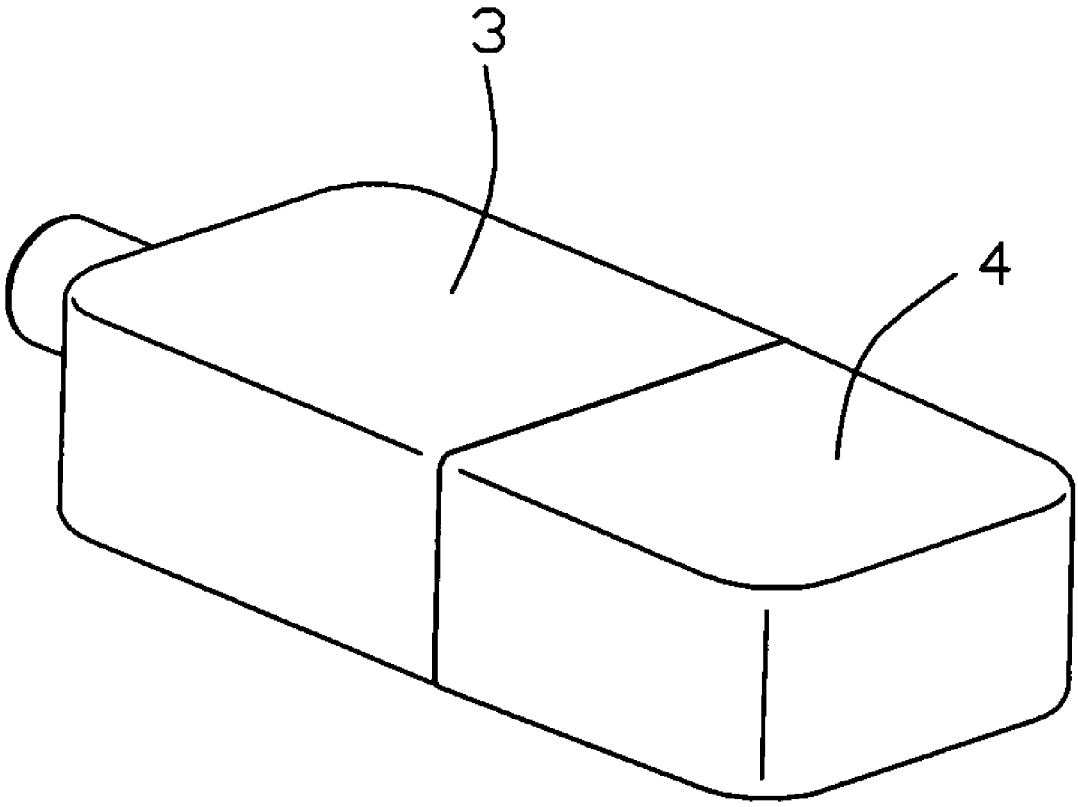
FIG. 3 is a perspective, assembled view of the dustproof cover and the electrical connector in a second embodiment.
Figure 4:
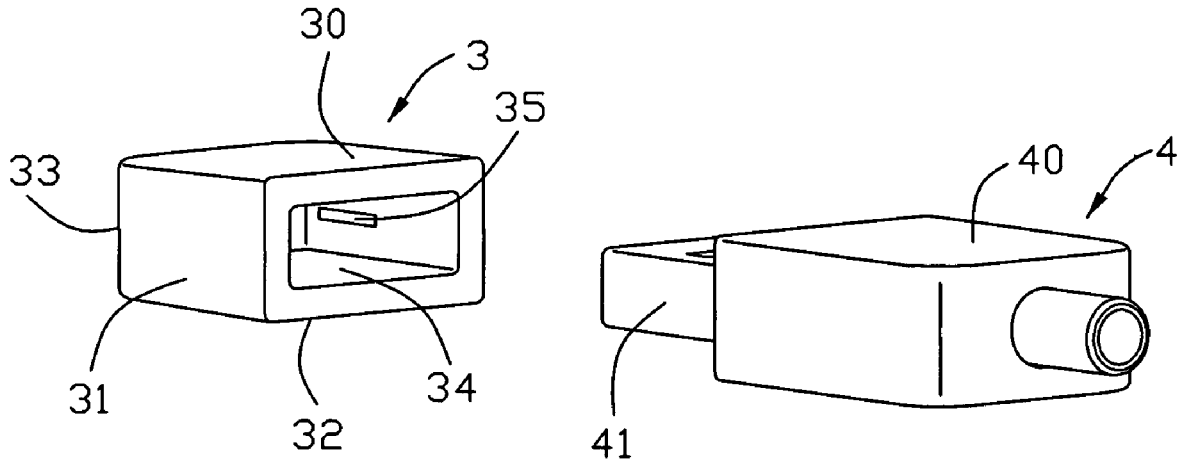
FIG. 4 is a perspective view of the dustproof cover removed from the electrical connector of FIG. 3.
Figure 5:
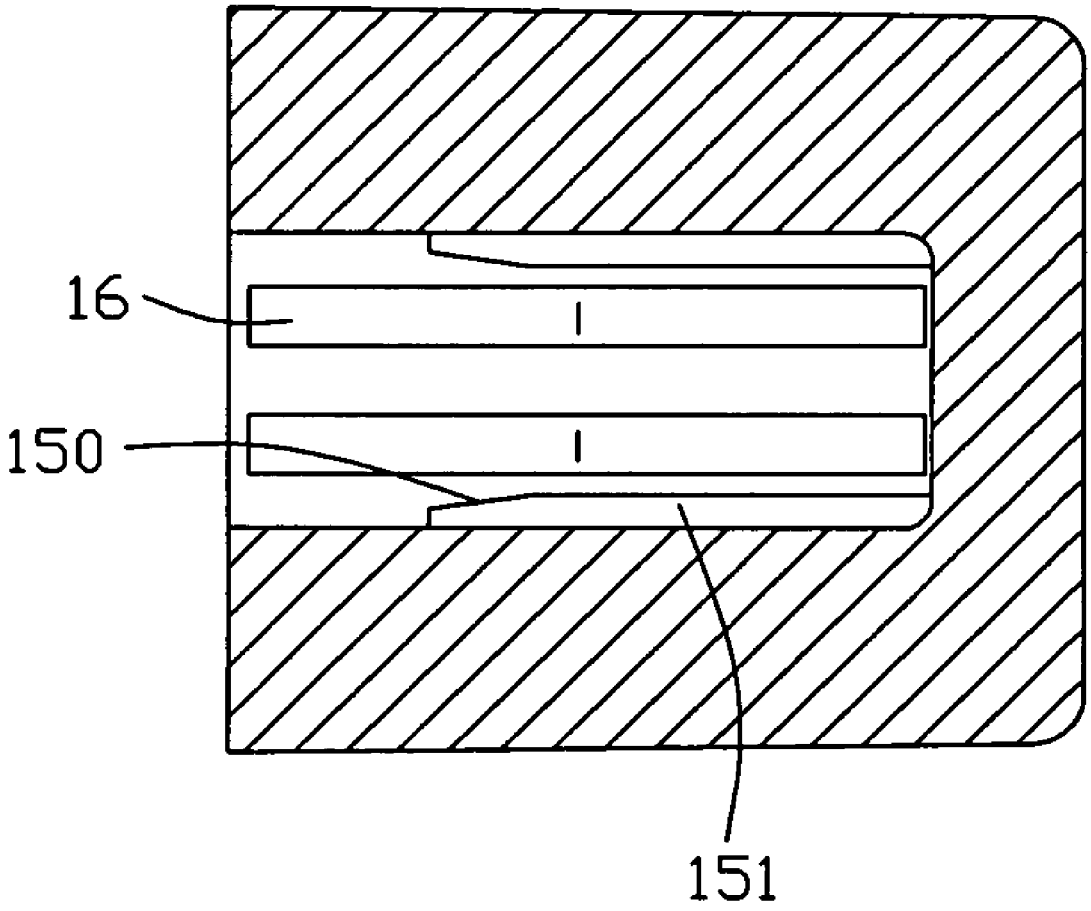
FIG. 5 is a cross-section view of the dustproof cover of FIG. 1.
Figure 6:
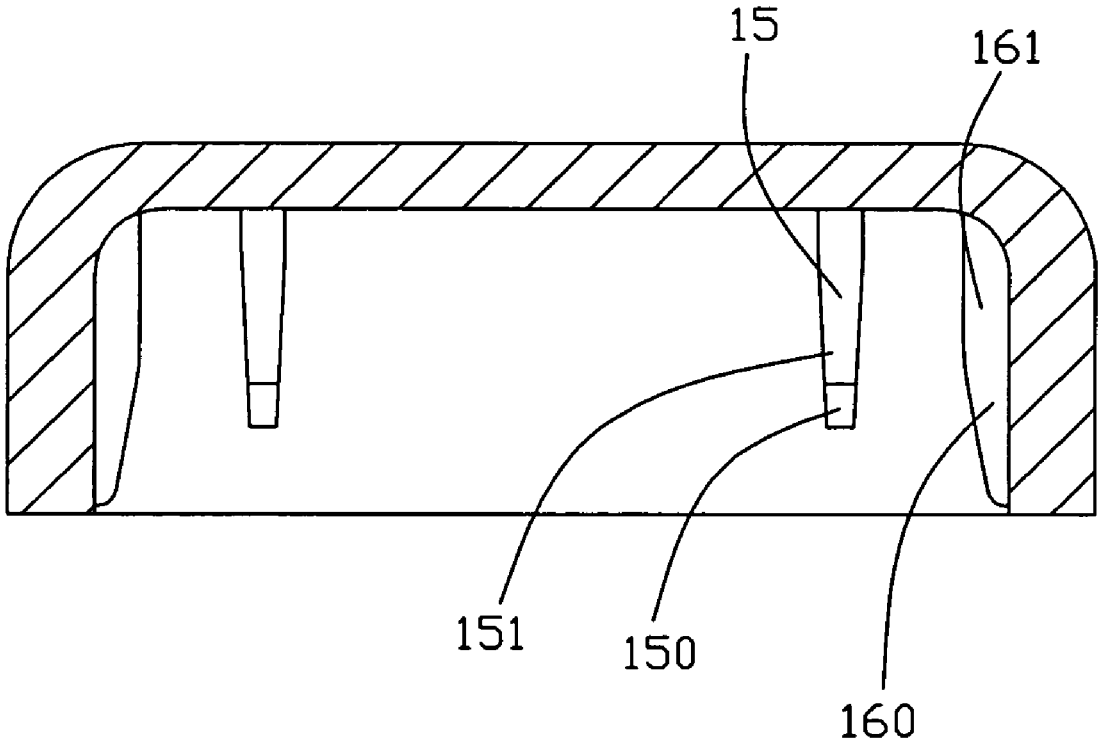
FIG. 6 is another cross-section view of the dustproof cover of FIG. 1.
Figure 7:
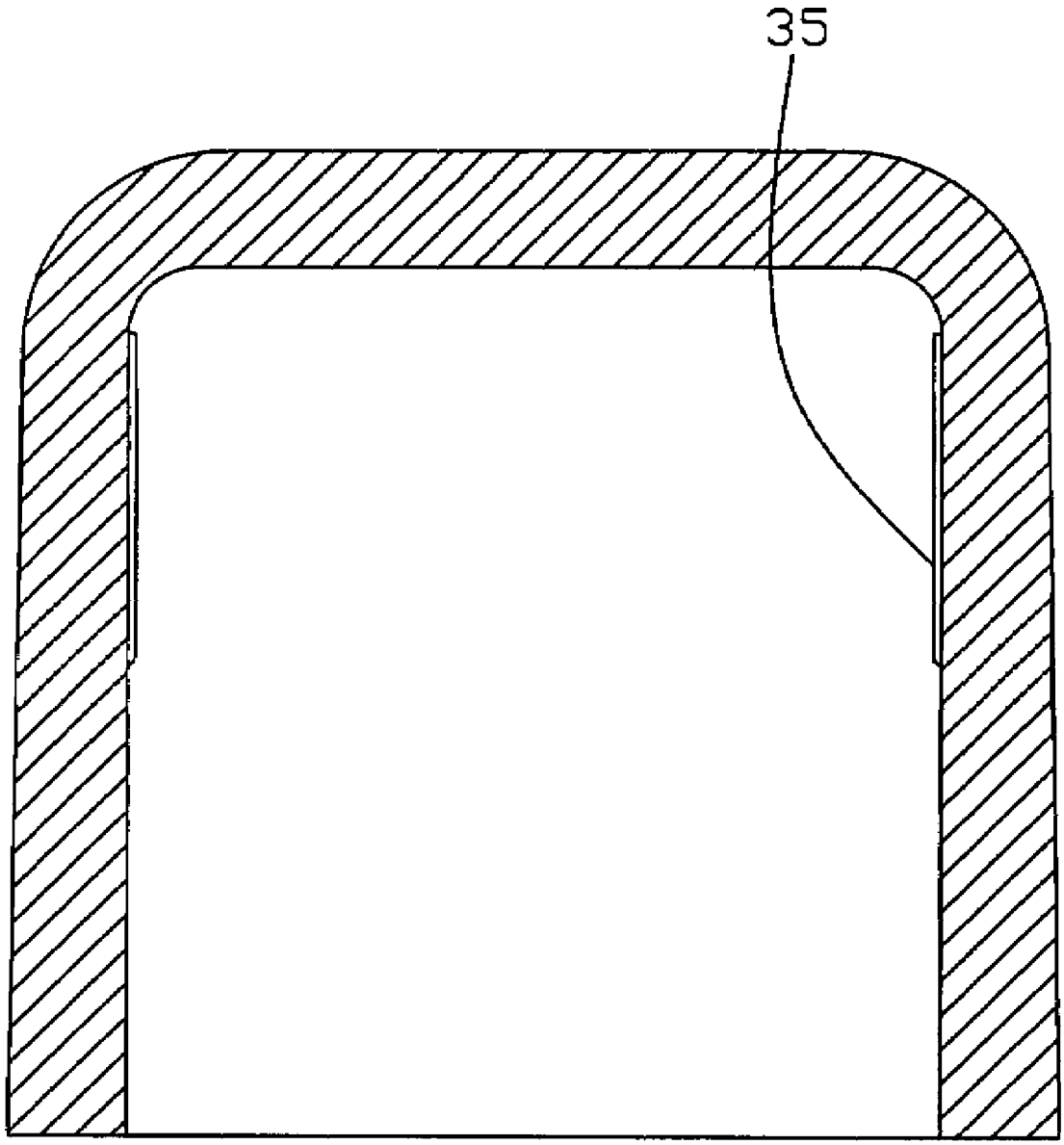
FIG. 7 is a cross-section view of the dustproof cover of FIG. 3.

FIGS. 3-4 and 7 indicate another embodiment of a dustproof cover 3 and an electrical connector 4 mating with the dustproof cover 3. The dustproof cover 3 comprises an upper wall 30, a bottom wall 32, a back wall 33 and a pair of lateral walls 31 being vertical to and respectively connecting with the upper, bottom and back walls 30, 32, 33. All of the upper wall 30, the lateral walls 31, the bottom wall 32 and the back wall 33 are smooth surfaces. The upper wall 30, the lateral walls 31 and the bottom wall 32 associate with the back wall 33 for defining a connector receiving room 34. At least a pair of ribs 35 is formed on the inner surfaces of the lateral walls 31, one facing towards the other. Each of the ribs 35 protrudes therefrom at a same height from one end to the other, which is different from the ribs 15, 16. The height of the rib 35 is also a small height for allowing the electrical connector 4 inserted smoothly therein. The electrical connector 4 comprises an insulating housing 40 and a plug end 41. The plug end 41 is fixedly received in the dustproof cover 3 in an interference fit manner thereby the ribs 35, and accordingly, the dustproof 3 is prevented from falling off the plug end 41.

In the two embodiments of this invention, the inner surfaces of the walls form a plurality of ribs 15, 16, 35. The dustproof covers 1, 3 shield over the plug ends 21, 41 of the electrical connectors 2, 4 when the electrical connectors 2, 4 are not in use. The dustproof covers 1, 3 are prevented from dropping off from the plug ends 21, 41 of the electrical connectors 2, 4 because of the plurality of ribs 15, 16, 35 formed thereon. The dustproof covers 1, 3 prevent the plug ends 21, 41 of the connectors 2, 4 from being damaged by external members, and furthermore, prevent the plug ends 21, 41 thereof from being dirtied by dust particles.

While a preferred embodiment in accordance with the present invention has been shown and described, equivalent modifications and changes known to persons skilled in the art according to the spirit of the present invention are considered within the scope of the present invention as described in the appended claims.

We claim:

1. A dustproof cover for an electrical connector, comprising:

opposite upper and bottom walls, a back wall, and a pair of opposite lateral walls associated with the upper, the bottom and the back walls to define a connector receiving room having an opening for allowing insertion/receipt of a mating port of the connector, the upper and bottom walls being larger than the lateral walls;

a first group of ribs formed on inner surfaces of the opposite upper and bottom walls; and a second group of ribs formed on inner surface of the pair of opposite lateral walls under a condition that the first group of ribs spaced from the opening with a first distance and the second group of ribs spaced from the opening with a second distance different from the first distance; wherein the first group of ribs and the second group of ribs are dimensioned for being snugly engaged with the rusting port of the connector.

2. The dustproof cover as claimed in claim 1, wherein the first distance is larger than the second distance.

3. An electrical connector assembly comprising:

an electrical connector defining a mating port with a pair of guiding slots formed in each of upper and bottom faces thereof;

a dustproof cover including opposite upper and bottom walls, a back wall, and a pair of opposite lateral walls associated wit the upper, the bottom and the back walls to define a connector receiving room having an opening for allowing insertion/receipt of the mating port of the connector, the upper and bottom walls being larger than the lateral walls;

a first group of ribs formed on inner surfaces of the opposite upper and bottom walls; and a second group of ribs formed on inner surface of the pair of opposite lateral walls under a condition that the first group of ribs spaced from the opening with a first distance and the second group of ribs spaced from the opening with a second distance different from the first distance; wherein the first soup of ribs and the second poup of ribs are dimensioned to be snugly engaged wit the mating port of the connector; wherein each of said first group of ribs is received in the corresponding guiding slot.

4. The electrical connector assembly as claimed in claim 3, wherein said mating port further defines a pair of latches on two opposite lateral faces thereof, and a corresponding pair of the second group of ribs are formed on each lateral face to compliantly receive the corresponding latch therebetween.

5. An electrical connector assembly comprising:

an electrical connector defining a matings port with a pair of guiding latches on two opposite lateral faces thereof;

a dustproof cover including opposite upper and bottom walls, a back wall, and a pair of opposite latent walls associated with the upper, the bottom and the back walls to define a connector receiving room having an opening for allowing insertion/receipt of the mating port of the connector, the upper and bottom walls being larger than the lateral walls;

a first group of ribs formed on inner surfaces of the opposite upper and bottom walls; and a second group of ribs formed on inner surface of the pair of opposite lateral walls under a condition that the first group of ribs spaced from the opening with a first distance and the second group of ribs spaced from the opening with a second distance different from the first distance; wherein the first group of ribs and the second group of ribs are dimensioned to be snugly engaged with the mating port of the connector; wherein a corresponding pair of the second group of ribs are formed on each of said lateral faces to compliantly receive the corresponding latch therebetween.

* * * * *